US005558057A

United States Patent [19]

Everts

[11] Patent Number: 5,558,057

[45] **Date of Patent: * Sep. 24, 1996**

[54] OPERATOR CARRIED POWER TOOL HAVING A FOUR-CYCLE ENGINE

[75] Inventor: Robert G. Everts, Chandler, Ariz.

[73] Assignee: Ryobi Outdoor Products, Chandler, Ariz.

[ * ] Notice: The portion of the term of this patent subsequent to Sep. 7, 2010, has been disclaimed.

[21] Appl. No.: 65,576

[22] Filed: May 2, 1993

Related U.S. Application Data

[63] Continuation of Ser. No. 801,026, Dec. 2, 1991, Pat. No. 5,241,932.

[51] Int. Cl.[6] ..... F02F 7/00

[52] U.S. Cl. ..... 123/195 R; 30/276

[58] Field of Search ..... 123/195 R, 90.33, 123/311, 84, 193.5, 196 R, 41.86; 184/6.5, 6.8, 6.9, 6.26, 11.1, 13.1; 30/276

[56] References Cited

U.S. PATENT DOCUMENTS

| | | | |
|---|---|---|---|
| 2,980,089 | 4/1961 | Sampietro | 123/90.65 |
| 4,380,216 | 4/1983 | Kandler | 123/90.65 |
| 4,508,068 | 4/1985 | Tuggle et al. | 123/187.5 R |
| 4,510,897 | 4/1985 | Hatz et al. | 123/90.48 |
| 4,662,323 | 5/1987 | Moriya | 123/90.23 |
| 4,674,146 | 6/1987 | Tuggle et al. | 15/330 |
| 4,716,861 | 1/1988 | Fujikawa et al. | 123/90.2 |
| 4,736,717 | 4/1988 | Fujikawa et al. | 123/90.2 |
| 4,762,098 | 8/1988 | Tamba et al. | 123/90.33 |
| 4,841,929 | 6/1989 | Tuggle et al. | 123/198 E |
| 4,846,123 | 7/1989 | Bolton, Jr. | 123/192.2 |
| 4,848,846 | 7/1989 | Yamada et al. | 30/276 |
| 4,936,271 | 6/1990 | Nagashima et al. | 123/195 C |
| 4,969,434 | 11/1990 | Nakagawa | 123/90.33 |
| 5,035,586 | 7/1991 | Sadler et al. | 417/363 |
| 5,058,542 | 10/1991 | Grayson et al. | 123/41.86 |
| 5,174,255 | 12/1992 | Collins et al. | 123/179.1 |

*Primary Examiner*—Noah P. Kamen
*Attorney, Agent, or Firm*—Brooks & Kushman P.C.

[57] ABSTRACT

A hand held powered tool is provided which is intended to be carried by an operator during use. The power tool has a frame, including a handle to be grasped by the operator, an implement affixed to the frame having a rotary input member and a small four-cycle lightweight internal combustion engine attached to the frame for driving the implement. The four-cycle engine is made up of a lightweight aluminum engine block having a cylindrical bore and an enclosed oil reservoir formed therein. A crankshaft is journaled to the engine block for rotation about a crankshaft axis. A piston reciprocates within the bore and is connected to the crankshaft by a connecting rod having oil splasher formed thereon for intermittently engaging the oil within the enclosed oil reservoir to splash lubricate the engine. The engine is provided with a cylinder head assembly defining a compact combustion chamber having a pair of overhead intake exhaust ports cooperating intake and exhaust valves. A lightweight high powered engine is thereby provided having relatively low HC and CO emissions.

2 Claims, 5 Drawing Sheets

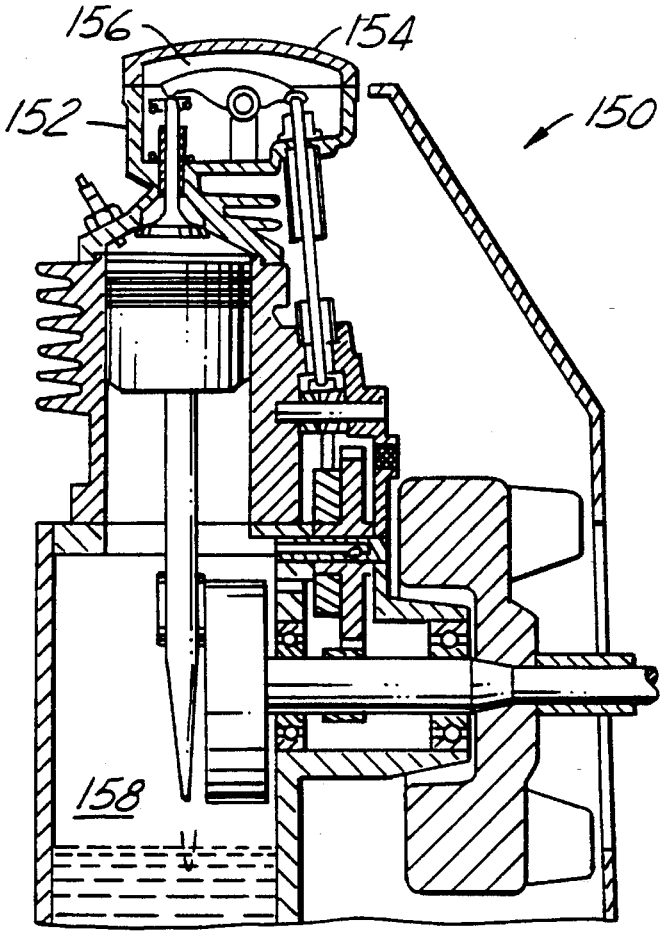
Fig-7
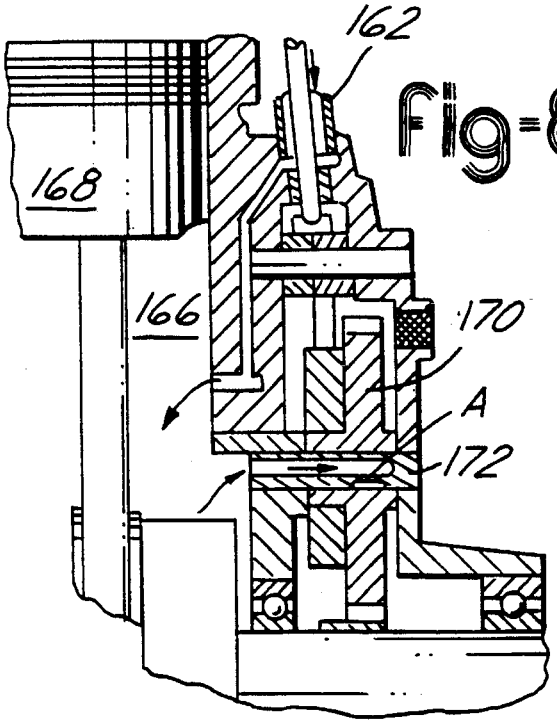
Fig-8
Fig-9
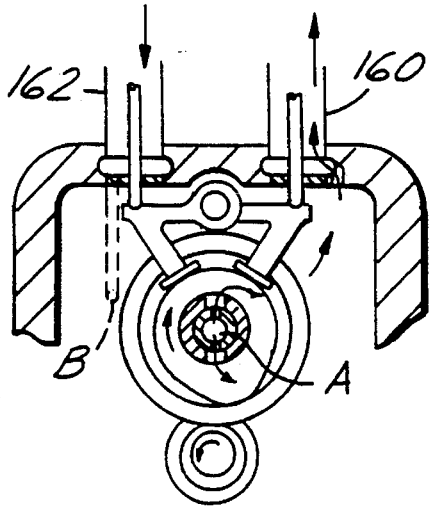

OPERATOR CARRIED POWER TOOL HAVING A FOUR-CYCLE ENGINE

This is a continuation of application Ser. No. 07/801,026 filed on Dec. 02, 1991, now U.S. Pat. No. 5,241,932.

Technical Field

This invention relates to operator carried power tools and more particularly, to operator carried power tools driven by a small internal combustion engine.

Background Art

Portable operator carried power tools such as line trimmers, blower/vacuums, or chain saws are currently powered by two-cycle internal combustion engines or electric motors. With the growing concern regarding air pollution, there is increasing pressure to reduce the emissions of portable power equipment. Electric motors unfortunately have limited applications due to power availability for corded products and battery life for cordless devices. In instances where weight is not an overriding factor such as lawn mowers, emissions can be dramatically reduced by utilizing heavier four-cycle engines. When it comes to operator carried power tools such as line trimmers, chain saws and blower/vacuums, four-cycle engines pose a very difficult problem. Four-cycle engines tend to be too heavy for a given horsepower output and lubrication becomes a very serious problem since operator carried power tools must be able to run in a very wide range of orientations.

The California Resource Board (CARB) in 1990 began to discuss with the industry, particularly the Portable Power Equipment Manufacturer's Association (PPEMA), the need to reduce emissions. In responding to the CARB initiative, the PPEMA conducted a study to evaluate the magnitude of emissions generated by two-cycle engines in an effort to determine whether they were capable of meeting the proposed preliminary CARB standards tentatively scheduled to go into effect in 1994. The PPEMA study concluded that at the present time, there was no alternative power source to replace the versatile lightweight two-stroke engine currently used in hand held products. Four-cycle engines could only be used in limited situations, such as in portable wheeled products like lawn mowers or generators, where the weight of the engine did not have to be borne by the operator.

It is an object of the present invention to provide a hand held powered tool which is powered by an internal combustion engine having low emissions and is sufficiently light to be carried by an operator.

It is a further object of the present invention to provide a portable hand held powered tool powered by a small internal combustion engine having an internal lubrication system enabling the engine to be run at a wide variety of orientations typically encountered during normal operation.

It is a further object of the present invention to provide a portable power tool to be carried by an operator which is driven by a small lightweight four-cycle engine having an aluminum engine block, an overhead valve train and a splasher lubrication system for generating an oil mist to lubricate the crank case throughout the normal range of operating positions.

It is yet a further object of the invention to provide an oil mist pumping system to pump an oil mist generated in the crank case into the overhead valve chamber.

These objects and other features and advantages of the present invention will be apparent upon further review of the remainder of the specification and the drawings.

Disclosure of the Invention

Accordingly, a portable hand held power tool of the present invention intended to be carried by an operator is provided utilizing a small four-cycle internal combustion engine as a power source. The four-cycle engine is mounted on a frame to be carried by an operator during normal use. The tool has an implement cooperating with the frame having a rotary driven input member coupled to the crankshaft of the four-cycle engine. The four-cycle engine is provided with a lightweight aluminum engine block having at least one cylindrical bore oriented in a normally upright orientation having an enclosed oil reservoir located therebelow. A crankshaft is pivotably mounted within the engine block. The enclosed oil reservoir when properly filled, enables the engine to rotate at least 30 degrees about the crankshaft axis in either direction without oil within the reservoir rising above the level of the crankshaft counter weight. A splasher is provided to intermittently engage the oil within the oil reservoir to generate a mist to lubricate the engine crank case.

One embodiment of the invention pumps an oil mist from the crank case to an overhead valve chamber to lubricate the valve train.

In yet another embodiment of the invention, the overhead valve chamber is sealed and is provided with a lubrication system independent of the crank case splasher system.

BRIEF DESCRIPTION OF THE DRAWINGS

FIG. 7 is a cross-sectional side elevational view of a third engine embodiment;

FIG. 8 is an enlarged cross-sectional view of the third engine embodiment of FIG. 7 illustrating the lubrication system;

FIG. 9 is a partial cross-sectional end view of the third engine embodiment shown in FIG. 7 and 8 further illustrating the lubrication system;

BEST MODES FOR CARRYING OUT THE INVENTION

Figure 1:
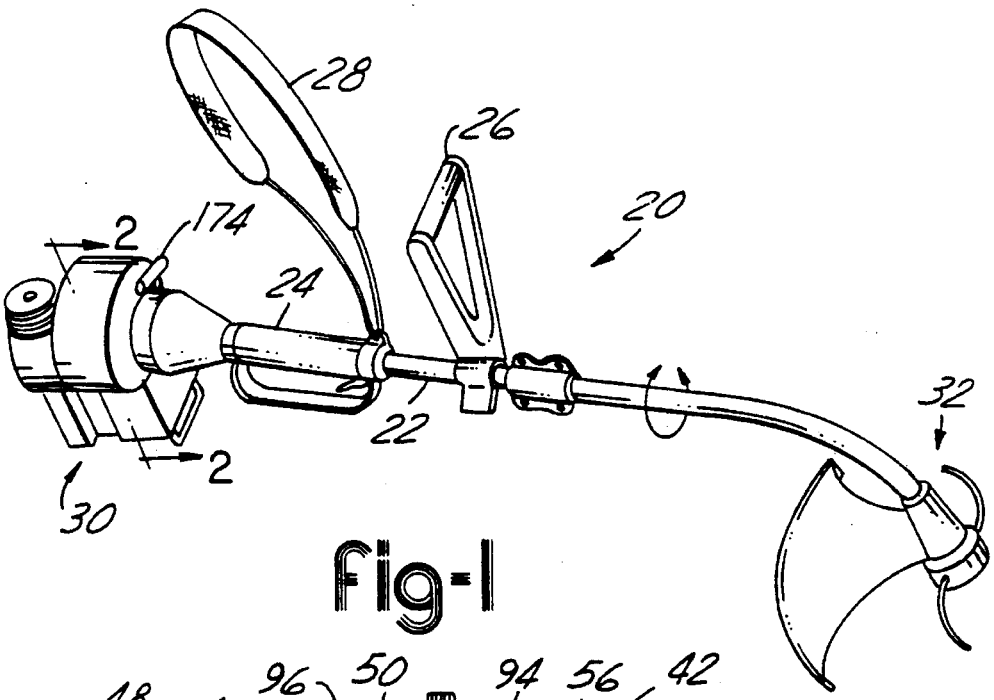
FIG. 1 is a perspective view illustrating a line trimmer of the present invention.

FIG. 1 illustrates a line trimmer 20 made in accordance with the present invention. Line trimmer 20 is used for illustration purposes and it should be appreciated that other hand held power tools tended to be carried by operators such as chain saws or a blower vacuum can be made in a similar fashion. Line trimmer 20 has a frame 22 which is provided by an elongated aluminum tube. Frame 22 has a pair of handles 24 and 26 to be grasped by the operator during normal use. Strap 28 is placed over the shoulder of the user in a conventional manner in order to more conveniently carry the weight of the line trimmer during use. Attached to one end of the frame generally behind the operator is a four-cycle engine 30. The engine drives a conventional flexible shaft which extends through the center of the tubular frame to drive an implement 32 having a rotary cutting head or the like affixed to the opposite end of the frame. It should be appreciated that in the case of a chain saw or a blower/vacuum, the implement would be a cutting chain or a rotary impeller, respectively.

Figure 2:
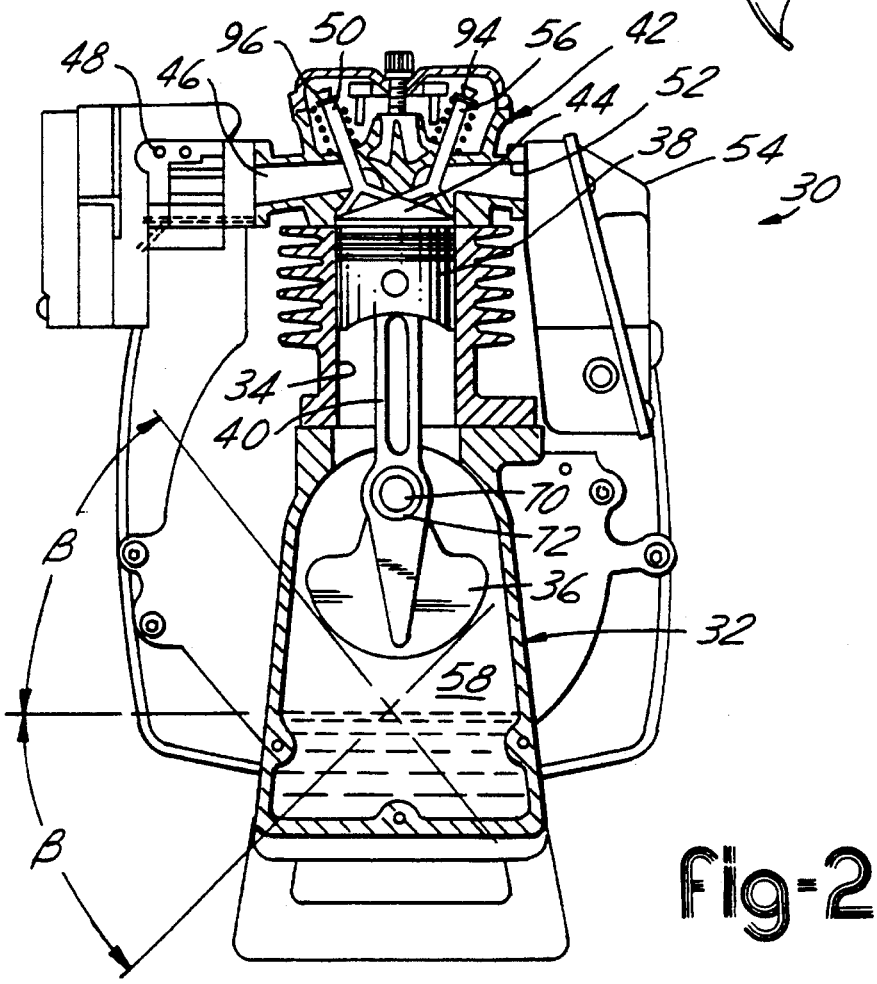
FIG. 2 is a cross-sectional side elevation of the engine taken along line 2.2 of FIG. 1.

FIG. 2 illustrates a cross-sectional end view of a four-cycle engine 30. Four-cycle engine 30 is made up of a lightweight aluminum engine block 32 having a cylindrical bore 34 formed therein. Crankshaft 36 is pivotably mounted within the engine block in a conventional manner. Piston 38 slides with a cylindrical bore 34 and is connected to the crankshaft by connecting rod 40. A cylinder head 42 is affixed to the engine block to define an enclosed combustion chamber 44. Cylinder head 42 is provided with intake port 46 coupled to a carburetor 48 and selectively connected to the combustion chamber 44 by intake valve 50. Cylinder head 42 is also provided with an exhaust port 52 connected to muffler 54 and selectively connected to combustion chamber 44 by exhaust valve 56.

Figure 3:
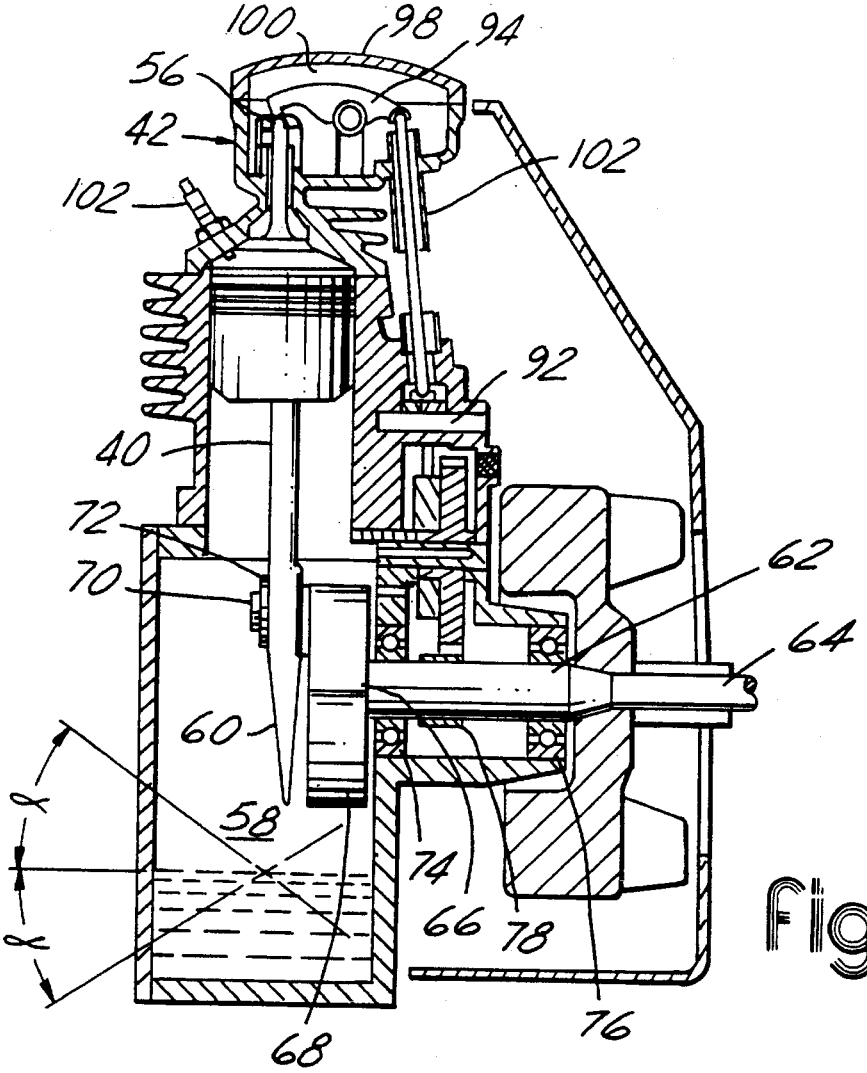
FIG. 3 is side cross-sectional elevational view of the engine of FIG. 2.

As illustrated in FIGS. 2 and 3, the cylinder axis of four-cycle engine 30 is generally upright when in normal use. Engine block 32 is provided with enclosed oil reservoir 58. The reservoir is relatively deep so that there is ample clearance between the crankshaft and the level of the oil during normal use. As illustrated in FIG. 2, the engine may be rotated about the crankshaft axis plus or minus at angle $\beta$ before the oil level would rise sufficiently to contact the crankshaft. Preferably, $\beta$ is at least above 30° and most preferably at least 45° in order to avoid excessive interference between the crankshaft and the oil within the oil reservoir. As illustrated in a cross-sectional side elevation shown in FIG. 3, the engine shown in its vertical orientation would typically be used in a line trimmer canted forward 20° to 30°. As illustrated, the engine can be tipped fore and aft plus or minus an angle $\alpha$ without the oil within the reservoir striking the crankshaft. Again, preferably the angle $\alpha$ is at least above 30° viewing the engine in side view along the transverse axis orthogonal to the axes of the engine crankshaft 36 and the cylinder bore 34.

In order to lubricate the engine, connecting rod 40 is provided with a splasher portion 60 which dips into the oil within the reservoir with each crankshaft revolution. The splasher 60 creates an oil mist which lubricates the internal moving parts within the engine block.

As illustrated in FIG. 3, the crankshaft 36 is of a cantilever design similar to that commonly used by small two-cycle engines. The crankshaft is provided with an axial shaft member 62 having an output end 64 adapted to be coupled to the implement input member and input end 66 coupled to a counterweight 68. A crankpin 70 is affixed to counterweight 68 and is parallel to and radially offset from the axial shaft 62. Crankpin 70 pivotally cooperates with a series of roller bearings 72 mounted in connecting rod 40. The axial shaft 62 of crankshaft 36 is pivotably attached to the engine block 32 by a pair of conventional roller bearings 74 and 76. Intermediate roller bearings 74 and 76 is camshaft drive gear 78.

Figure 4:
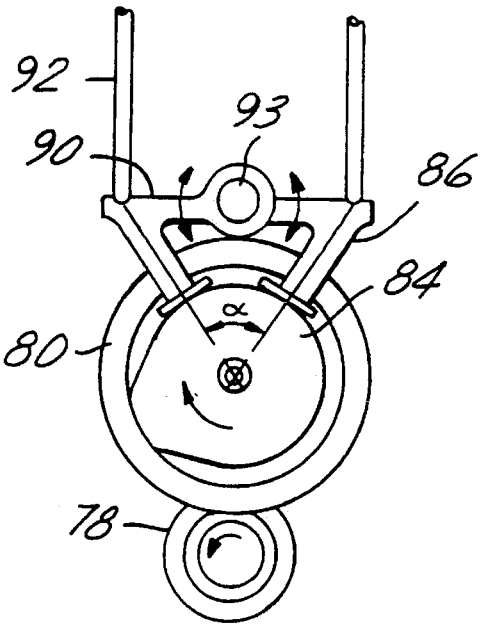
FIG. 4 is an enlarged schematic illustration of the cam shaft and the follower mechanism.

The camshaft drive and valve lifter mechanism is best illustrated with reference to FIGS. 3 and 4. Drive gear 78 which is mounted upon the crankshaft drives cam gear 80 which is twice the diameter resulting in the camshaft rotating in one-half engine speed. Cam gear 80 is affixed to the camshaft assembly 82 which is journaled to engine block 32 and includes a rotary cam lobe 84. In the embodiment illustrated, a single cam lobe is utilized for driving both the intake and exhaust valves, however, a conventional dual cam system could be utilized as well. Cam lobe 84 as illustrated in FIG. 4, operates intake valve follower 86 and intake push rod 88 as well as exhaust valve follower 90 and exhaust push rod 92. Followers 86 and 90 are pivotably connected to the engine block by pivot pin 92. Push rods 88 and 92 extend between camshaft followers 86 and 90 and rocker arms 94 and 96 located within the cylinder head 42. Affixed to the cylinder head 42 is a valve cover 98 which defines therebetween enclosed valve chamber 100. A pair of push rod tubes 102 surround the intake and exhaust push rods 88 and 92 in a conventional manner in order to prevent the entry of dirt into the engine. In the embodiment of the invention illustrated, four-cycle engine 30 has a sealed valve chamber 100 which is isolated from the engine block and provided with its own lubricant. Preferably, valve chamber 100 is partially filled with a lightweight moly grease. Conventional valve stem seals, not shown, are provided in order to prevent escape of lubricant.

Engine 30 operates on a conventional four-cycle mode. Spark plug 104 is installed in a spark plug hole formed in the cylinder head so as to project into enclosed combustion chamber 44. The intake charge provided by carburetor 48 will preferably have an air fuel ratio which is slightly lean stoichiometric, i.e., having an air fuel ratio expressed in terms of stoichiometric ratio which is not less than 1.0. It is important to prevent the engine from being operated rich as to avoid a formation of excessive amounts of hydrocarbon (HC) and carbon monoxide (CO) emissions. Most preferably, the engine will operate during normal load conditions slightly lean of stoichiometric in order to minimize the formation of HC, CO and oxides of nitrogen (NOx). Running slightly lean of stoichiometric air fuel ratio will enable excess oxygen to be present in the exhaust gas thereby fostering post-combustion reduction of hydrocarbons within the muffler and exhaust port.

For use in a line trimmer of the type illustrated in FIG. 1, adequate power output of a small lightweight four-cycle engine is achievable utilizing an engine with a displacement less than 50 cc. Preferably, engines for use in the present invention will have a displacement falling within the range of 20 and 40 cc. Engines of displacement larger than 50 cc. will result in excessive weight to be carried by an operator. Engines of smaller displacement will have inadequate power if operated in such a manner to maintain low emission levels.

In order to achieve high power output and relatively low exhaust emissions, four-cycle engine 30 is provided with a very compact combustion chamber 44 having a relatively low surface to volume ratio. In order to maximize volumetric efficiency and engine output for relatively small engine displacement, canted valves shown in FIG. 2 are used resulting in what is commonly referred to as a hemispherical-type chamber. Intake and exhaust ports 46 and 52 are oriented in line and opposite one another resulting in a cross flow design capable of achieving very high horsepower relative to engine displacement compared to a typical four-cycle lawn mower engine having a flat head and a valve-in-block design.

Figure 5:
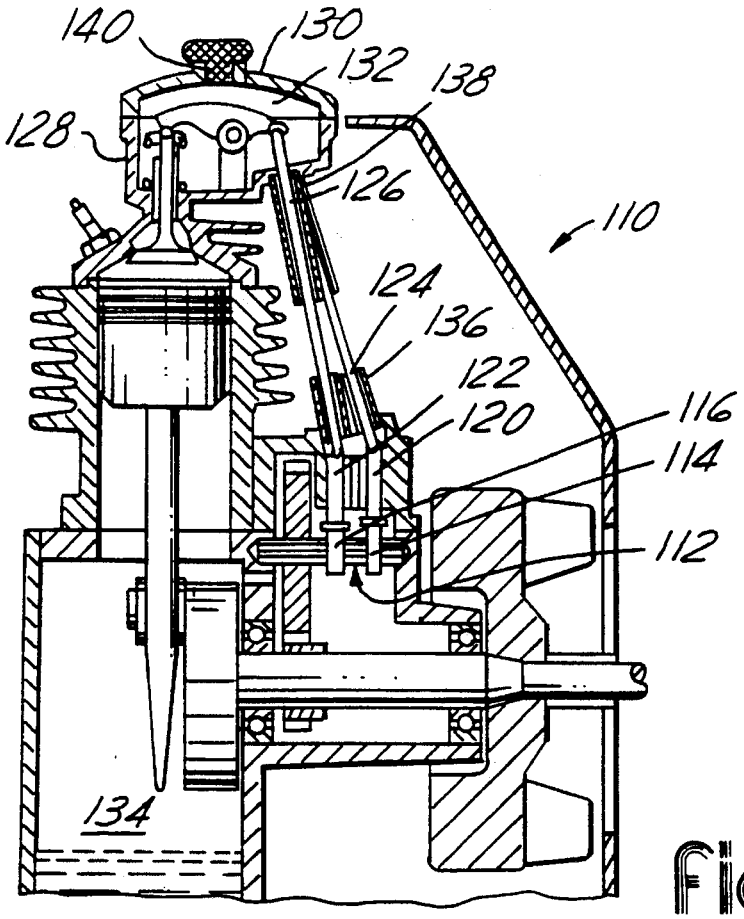
FIG. 5 is a cross-sectional side elevational view of a second engine embodiment.
Figure 6:
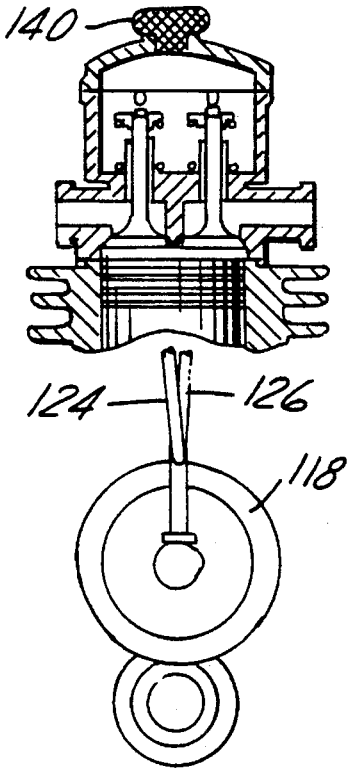
FIG. 6 is a cross-sectional end view illustrating the valve train of the second engine embodiment of FIG. 5.

A second engine embodiment 110 is illustrated in FIGS. 5 and 6. Engine 110 is very similar to engine 30 described with reference to FIGS. 2–4 except for the valve train and lubrication system design. Engine 110 is provided with a camshaft 112 having a pair of cam lobes, intake cam lobes 114 and exhaust cam lobes 116 affixed to the camshaft and at axially spaced apart orientation. Camshaft 112 is further provided with a cam gear 119 cooperating with a drive gear 118 affixed to the crankshaft as previously described with reference to the first engine embodiment 30. Intake and exhaust followers 120 and 122 are slidably connected to the engine block and are perpendicular to the axis of the camshaft in a conventional manner. Intake and exhaust followers 120 and 122 reciprocally drive intake and exhaust push rods 124 and 126.

Engine 110 also differs from engine 30 previously described in the area of cylinder head lubrication. Cylinder head 128 and valve cover 130 define therebetween an enclosed valve chamber 132. Valve chamber 132 is coupled to oil reservoir 134 by intake and exhaust push rod guide tubes 136 and 138. Valve cover 130 is further provided with a porous breather 140 formed of a sponge-like or sintered metal material. As the piston reciprocates within the bore, the pressure within the oil reservoir will fluctuate. When the pressure increases, mist ladened air will be forced through the valve guide tubes into the valve chamber 132. When the piston rises, the pressure within the oil reservoir 134 will drop below atmospheric pressure causing air to be drawn into the engine breather 140. The circulation of mist ladened air between the engine oil reservoir and the valve chamber will supply lubrication to the valves and rocker arms. By forming the breather of a porous material, the escape of oil and the entry of foreign debris will be substantially prohibited.

FIG. 7–10 illustrate a third engine embodiment 150 having yet a third system for lubricating overhead valves. Engine 150 has an engine block with a single cam and dual follower design generally similar to that of FIGS. 2 and 3 described previously. Cylinder head 152 is provided with a valve cover 154 to define enclosed valve chamber 156 therebetween. Valve chamber 156 iS coupled to oil reservoir 158 within the engine block. In order to induce the mist ladened air within the oil reservoir 158 to circulate through valve chamber 156, flow control means is provided for alternatively selectively coupling the valve chamber to the oil reservoir via one of a pair of independent fluid passageways.

As illustrated in FIGS. 8 and 9, intake push rod tube 160 provides a first passageway connecting the oil reservoir to the valve chamber, while exhaust push rod tube 162 provides a second independent passageway connecting the valve chamber 156 to the oil reservoir 158. As illustrated in FIG. 8, port B connects push rod tube 162 to the cylindrical bore 166. Port B intersects the cylindrical bore at a location which is swept by the skirt of piston 168 so that the port is alternatively opened and closed in response to piston movement. Camshaft 170 is pivotally mounted on a hollow tubular shaft 172. Camshaft 170 and support shaft 172 are each provided with a pair of ports A which are selectively coupled and uncoupled once every engine revolution, i.e., twice every camshaft revolution. When the ports are aligned, the oil reservoir is fluidly coupled to the valve chamber via the intake push rod tube 170. When the ports are misaligned, the flow path is blocked.

Figure 10:
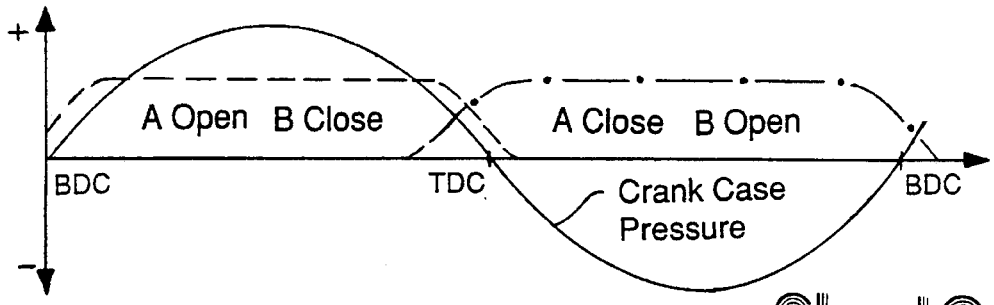
FIG. 10 is a timing diagonal of the lubrication system of the third engine embodiment.

FIG. 10 schematically illustrates the open and close relationship of the A and B ports relative to crankcase pressure. When the piston is down and the crankcase is pressurized, the A port is open allowing mist ladened air to flow through the passageway within camshaft support shaft 172 through the intake push rod tube 160 and into the valve chamber 156. When the piston rises, the crankcase pressure drops below atmospheric pressure. When the piston is raised, the A port is closed and the B port is opened enabling the pressurized air from valve chamber 156 to return to oil reservoir 158.

Of course, other means for inducing the circulation of misladened air from the oil reservoir to the valve chamber can be used to obtain the same function, such as check valves or alternative mechanically operated valve designs. Having a loop type flow path as opposed to a single hi-directional flow path, as in the case of the second engine embodiment 110, a more dependable supply of oil can be delivered to the valve chamber.

Figure 11:
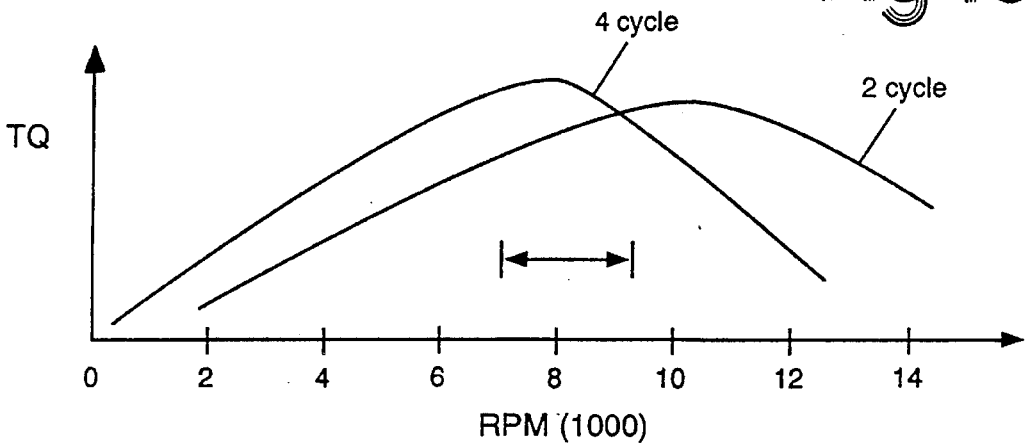
FIG. 11 is a torque versus RPM curve.

It is believed that small lightweight four-cycle engines made in accordance with the present invention will be particularly suited to use with rotary line trimmers, as illustrated in FIG. 1. Rotary line trimmers are typically directly driven. It is therefore desirable to have an engine with a torque peak in the 7000 to 9000 RPM range which is the range in which common line trimmers most efficiently cut. As illustrated in FIG. 11, a small four-cycle engine of the present invention can be easily tuned to have a torque peak corresponding to the optimum cutting speed of a line trimmer head. This enables a smaller horsepower engine to be utilized to achieve the same cutting performance as compared to a higher horse power two-cycle engine which is direct drive operated. Of course, a two-cycle engine speed can be matched to the optimum performance speed of the cutting head by using a gear reduction however, this unnecessarily adds cost, weight and complexity to a line trimmer.

Figure 12:
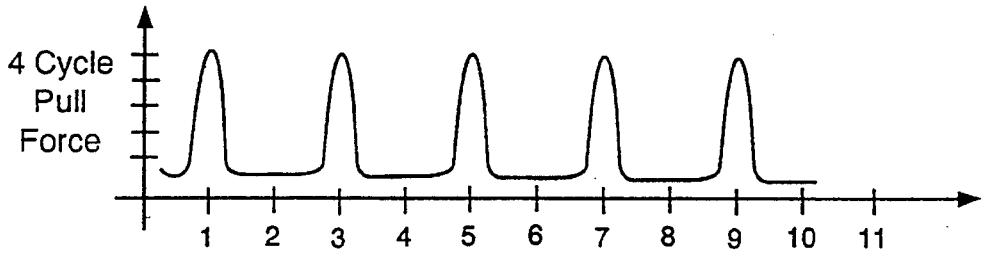
FIG. 12 and FIG. 13 contrast the pull force of a four and a two-cycle engine.
Figure 13:
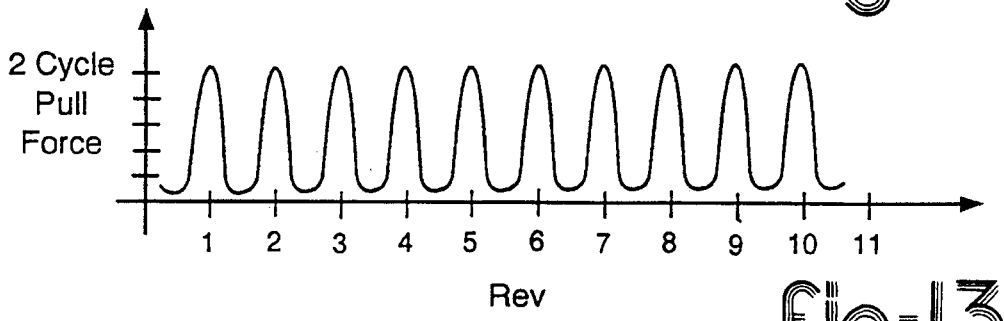

Another advantage to the four-cycle engine for use in a line trimmer is illustrated with reference to FIGS. 12 and 13. FIG. 12 plots the starter rope pull force versus engine revolutions. The force pulses occur every other revolution due to the four-cycle nature of the engine. A two-cycle engine as illustrated in FIG. 13 has force pulses every revolution. It is therefore much easier to pull start a four-cycle engine to reach a specific starting RPM since approximately half of the work needs to be expended by the operator. Since every other revolution of a four-cycle engine constitutes a pumping loop where there is relatively little cylinder pressure, the operator pulling starter rope handle 174 (shown in FIG. 1) is able to increase engine angular velocity during the pumping revolution so that proper starting speed and sufficient engine momentum can be more easily achieved. The pull starter mechanism utilized with the four-cycle engine is of a conventional design. Preferably, the pull starter will be located on the side of the engine closest to the handle in order to reduce the axial spacing between trimmer handle 24 and the starter rope handle 174, thereby minimizing the momentum exerted on the line trimmer during start up. A four-cycle engine is particularly advantageous in line trimmers where in the event the engine were to be shut off when the operator is carrying the trimmer, the operator can simply restart the engine by pulling the rope handle 174 with one hand and holding the trimmer handle 24 with the other. The reduced pull force makes it relatively easy to restart the engine without placing the trimmer on the ground or restraining the cutting head, as is frequently done with two-cycle line trimmers.

It should be understood, of course, that while the invention herein shown and described constitutes a preferred embodiment of the invention, it is not intended to illustrate all possible variations thereof. Alternative structures may be created by one of ordinary skill in the art without departing from the spirit and scope of the invention described in the following claims.

What is claimed is:

1. A power tool comprising:

a frame to be carried by an operator;

an implement cooperating with the frame and having a rotary driven input member; and a lightweight four-cycle internal combustion engine attached to the frame, said engine having:

an engine block having a cylindrical bore and an enclosed oil reservoir located below the cylindrical bore;

a piston reciprocally cooperating within the bore;

a crankshaft rotatably cooperating with the block and aligned along a crank axis perpendicular to the cylindrical bore, said crankshaft operably connected to the implement input member;

a connecting rod operatively connected between the piston and the crankshaft such that reciprocation of the piston is transformed into rotation of the crankshaft, a cylinder head assembly cooperating with the block, the cylinder head assembly having an intake and an exhaust valve respectively disposed in an intake and an exhaust port, wherein said ports are generally in line and oriented opposed to one another in a cross flow manner, and a valve train for opening and closing the intake and exhaust valves in timed sequence at one half crankshaft speed.

2. A power tool comprising:

a frame to be carried by an operator;

an implement cooperating with the frame and having a rotary driven input member; and a lightweight four-cycle internal combustion engine having:

an engine block having cylindrical bore and an enclosed oil reservoir located below the cylindrical bore;

a piston reciprocally cooperating within the bore;

a crankshaft rotatably cooperating with the block and aligned along a crank axis perpendicular to the cylindrical bore, said crankshaft operably connected to the implement input member;

a connecting rod operatively connected between the piston and the crankshaft such that reciprocation of the piston is transformed into rotation of the crankshaft;

a cylinder head assembly cooperating with the block, the cylinder head assembly having an intake and exhaust valve respectively disposed in an intake and an exhaust port;

a valve train for opening and closing the intake and exhaust valves in timed sequence at one half crankshaft speed;

a valve cover attached to the cylinder head to define a valve chamber therebetween; and a head lubrication system including first and second passageways connecting the oil reservoir to the valve chamber to provide an oil mist to the valve chamber, and means for selectively opening and closing the passageways to induce the circulation of oil laden mist between the oil reservoir and the valve chamber.

* * * * *